US009514858B2

(12) United States Patent
Brismalein

(10) Patent No.: US 9,514,858 B2
(45) Date of Patent: Dec. 6, 2016

(54) OXIDATION-RESISTANT ELONGATE ELECTRICALLY CONDUCTIVE ELEMENT

(71) Applicant: NEXANS, Paris (FR)

(72) Inventor: Christophe Brismalein, Lievin (FR)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 14/571,411

(22) Filed: Dec. 16, 2014

(65) Prior Publication Data

US 2015/0179303 A1 Jun. 25, 2015

(30) Foreign Application Priority Data

Dec. 19, 2013 (FR) ..... 13 63053

(51) Int. Cl.

| | |
|---|---|
| ***H01B 5/00*** | (2006.01) |
| ***H01B 7/28*** | (2006.01) |
| ***H01B 1/02*** | (2006.01) |
| ***H01B 7/02*** | (2006.01) |
| ***H01B 9/00*** | (2006.01) |
| ***C25D 3/58*** | (2006.01) |
| ***C25D 5/48*** | (2006.01) |
| ***C25D 7/06*** | (2006.01) |

(52) U.S. Cl.

CPC ..... *H01B 7/2806* (2013.01); *C25D 3/58* (2013.01); *C25D 5/48* (2013.01); *C25D 7/0607* (2013.01); *H01B 1/026* (2013.01); *H01B 7/02* (2013.01); *H01B 9/006* (2013.01); *Y10T 428/1291* (2015.01); *Y10T 428/12569* (2015.01); *Y10T 428/12715* (2015.01)

(58) Field of Classification Search

CPC ..... H01B 7/2806; H01B 1/026; H01B 7/02; H01B 9/006; C25D 3/58; C25D 3/60; C25D 5/48; C25D 7/0607

USPC ..... 174/126.1, 126.2

See application file for complete search history.

(56) References Cited

U.S. PATENT DOCUMENTS

| | | | | |
|---|---|---|---|---|
| 3,097,965 | A * | 7/1963 | Wilkins | B23K 35/0272 228/254 |
| 4,968,867 | A * | 11/1990 | Banzai | B23H 7/08 219/69.12 |
| 5,516,408 | A | 5/1996 | Peckham et al. | |
| 6,187,454 | B1 | 2/2001 | Rivassou | |
| 6,319,604 | B1 * | 11/2001 | Xu | H01B 3/305 174/102 P |
| 2003/0019661 | A1 * | 1/2003 | Aoyama | H01B 1/026 174/126.1 |
| 2006/0054347 | A1 * | 3/2006 | Agostinelli | C23C 2/02 174/106 R |
| 2013/0189540 | A1 | 7/2013 | McDaniel et al. | |

FOREIGN PATENT DOCUMENTS

| | | |
|---|---|---|
| JP | 2006077307 | 3/2006 |

OTHER PUBLICATIONS

Search Report Dated 2014.

* cited by examiner

*Primary Examiner* — Sherman Ng

(74) *Attorney, Agent, or Firm* — Soler & Haroun, LLP

(57) ABSTRACT

An elongate electrically conductive element has a core made of copper or copper alloy and at least one white-bronze layer encircling the core made of copper or copper alloy, wherein the white-bronze layer is the outermost layer of the elongate electrically conductive element.

13 Claims, 1 Drawing Sheet

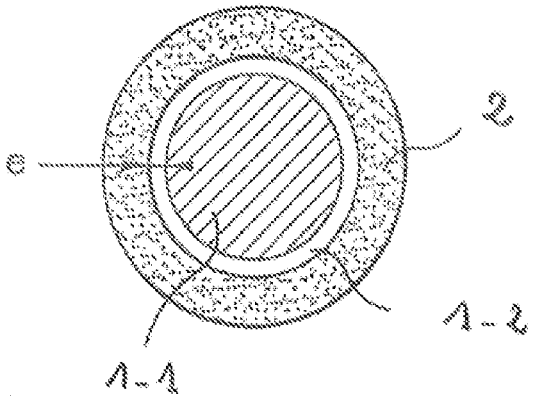
e
2
1-2
1-1

OXIDATION-RESISTANT ELONGATE ELECTRICALLY CONDUCTIVE ELEMENT

RELATED APPLICATION

This application claims the benefit of priority from French Patent Application No. 13 63053, filed on Dec. 19, 2013, the entirety of which is incorporated by reference.

BACKGROUND

Field of the Invention

The present invention relates to an elongate electrically conductive element comprising a core made of copper or copper alloy and at least one white-bronze layer, and to an electrical cable comprising at least one such an elongate electrically conductive element.

The present invention typically, but not exclusively, applies to low-voltage (especially lower than 6 kV) or medium-voltage (especially from 6 to 45-60 kV) power cables used in buildings, automobiles and in the field of rail transportation.

More particularly, the invention relates to an electrical cable having a good resistance to corrosion while guaranteeing good mechanical and electrical properties, especially in terms of temperature withstand and electrical conductivity.

Description of Related Art

A metal part (e.g. a high-frequency coaxial connector body made of brass) on which is deposited a copper layer then an anti-corrosion coating comprising a white-bronze layer is known from document EP 0 893 157A1, a palladium layer covering said white-bronze layer and a gold layer covering said palladium layer. White bronze is an alloy of copper and tin generally containing between 20 and 40% by weight tin. By virtue of this coating, said metal part is made resistant to corrosion while preserving a good solderability. However, the chemical composition of the white-bronze layer used is not described, the presence of a palladium layer and/or a gold layer on said part decreases its electrical conductivity, and the use of a gold layer as the outermost layer of the metal part decreases its deformation resistance. Furthermore, this metal part has the drawback of being very expensive because precious metals such as palladium and gold are used, and because of its manufacturing method, which requires a number of steps to form the various metal layers. Lastly, this metal part is not used to produce an electrical cable.

OBJECTS AND SUMMARY

The aim of the present invention is to mitigate the drawbacks of prior-art techniques by providing an elongate electrically conductive element comprising a core made of copper or copper alloy and at least one white-bronze layer, said elongate electrically conductive element being economical and having a good corrosion resistance while guaranteeing good electrical properties, especially in terms of electrical conductivity, and good mechanical properties, especially in terms of temperature withstand. In particular, during the manufacture of an electrical cable comprising one or more elongate electrically conductive elements, the one or more elongate electrically conductive elements are generally insulated using an electrically insulating layer made of plastic, such as a layer comprising polytetrafluoroethylene (PTFE), the application of which (e.g. by extrusion) requires a heat treatment step at a temperature of about 370° C. for ten minutes, meaning that the electrical cable must be able to withstand such a temperature.

The first subject of the present invention is therefore an elongate electrically conductive element comprising a core made of copper or copper alloy and at least one white-bronze layer encircling said core made of copper or copper alloy, characterized in that said white-bronze layer is the outermost layer of the elongate electrically conductive element.

In the invention, the expression "elongate electrically conductive element" is understood to mean an electrically conductive element having a longitudinal axis. In particular, the electrically conductive element is elongate because it has undergone at least one drawing step (cold deformation step, especially through dies made of diamond).

In the invention, the expression "white-bronze layer" is understood to mean a layer containing copper and at least 20% by weight tin.

In the invention, the expression "said white-bronze layer is the outermost layer of the elongate electrically conductive element" is understood to mean that the white-bronze layer of the elongate electrically conductive element of the invention is covered by no other metal layer.

In other words, the entirety of the exterior surface of the white-bronze layer (i.e. the entirety of the surface furthest from the elongate electrically conductive element) is covered by no other metal layer, For example, said white-bronze layer is not covered by a palladium layer and/or a gold layer and/or a layer made of tin.

By virtue of this white-bronze layer that is the outermost of the electrically conductive element, oxidation in air of the elongate electrically conductive element of the invention is prevented both at room temperature (i.e. at 20° C.) and at high temperatures ranging from 200° C. to 400° C. Moreover, the white-bronze layer used in the elongate electrically conductive element of the invention, in contrast to other prior-art anticorrosion coatings (e.g. nickel), is not toxic to the environment. Lastly, the elongate electrically conductive element of the invention preserves good electrical properties, especially in terms of electrical conductivity, resistivity and resistance per unit length, good mechanical properties, especially in terms of tensile strength, and a good solderability.

The white-bronze layer especially extends along the longitudinal axis of the elongate electrically conductive element.

The white-bronze layer preferably has a substantially regular surface. Thus, the white-bronze layer forms a continuous jacket (without irregularities or roughness) encircling said core made of copper or copper alloy.

According to one particularly preferred embodiment of the invention, the white-bronze layer of the elongate electrically conductive element contains at most 57% by weight tin, and preferably at most 40% by weight tin.

In one particular embodiment, the white-bronze layer of the elongate electrically conductive element of the invention furthermore contains zinc. The combination of copper, of at least 20% by weight tin and of zinc allows a layer having both a good temperature withstand and a good corrosion resistance to be obtained.

It is preferable for said white-bronze layer to contain uniquely only tin (in an amount of at least 20% by weight), copper and zinc. Specifically, if other elements are added to said layer, the electrical conductivity and/or tensile strength may substantially decrease, especially at high temperatures.

In one particular embodiment, the white-bronze layer of the elongate electrically conductive element of the invention contains from about 40 to 55% by weight copper, and preferably from about 45 to 53% by weight copper. If the amount of copper in the white-bronze layer is higher than 55% by weight, the corrosion resistance of the elongate electrically conductive element of the invention may be decreased. If the amount of copper is lower than 40% by weight, the electrical conductivity of the elongate electrically conductive element of the invention may be decreased.

In one particular embodiment, the white-bronze layer of the elongate electrically conductive element of the invention contains from about 30 to 57% by weight tin, and preferably from about 31 to 38% by weight tin. If the amount of tin is higher than 57% by weight, the temperature withstand of the elongate electrically conductive element of the invention may be decreased. If the amount of tin is lower than 30% by weight, the elongate electrically conductive element of the invention may have a low corrosion resistance.

In one preferred embodiment, the white-bronze layer of the elongate electrically conductive element of the invention contains from about 3 to 20% by weight zinc, and preferably from about 13 to 18% by weight zinc. If the amount of zinc in the white-bronze layer is higher than 20% by weight, the corrosion resistance of the elongate electrically conductive element of the invention may be decreased. If the amount of zinc is lower than 3% by weight, the temperature withstand and tensile strength of the elongate electrically conductive element of the invention may be decreased.

The white-bronze layer of the elongate electrically conductive element of the invention may have a thickness ranging from 0.1 μm to 100 μm, preferably from 2 to 10 μm and even more preferably from 3 to 7 μm.

In one particular embodiment, the elongate electrically conductive element does not comprise a layer made of nickel and/or a layer made of copper, especially encircling the core made of copper or copper alloy. In particular, the presence of a nickel layer may degrade the electrical conductivity properties of the elongate electrically conductive element.

In one preferred embodiment, the white-bronze layer makes direct contact (i.e. direct physical contact) with the core made of copper or copper alloy.

In other words, the elongate electrically conductive element of the invention does not comprise any intermediate layers positioned between the core made of copper or copper alloy and the white-bronze layer.

The core made of copper or copper alloy may have a cross-sectional area ranging from 0.3 $mm^2$ to 85 $mm^2$, and preferably ranging from 0.3 $mm^2$ to 70 $mm^2$.

The core made of copper or copper alloy preferably has a cross section that is round in shape.

Advantageously, the white-bronze layer is deposited on the core made of copper or copper alloy by electrodeposition.

The electrodeposition is carried out using techniques we known to those skilled in the art. Preferably, the electrodeposition is performed in an alkaline medium (i.e. of pH>7) and preferably at a pH ranging from 13.1 to 13.5.

The electrodeposition may also be performed in an acid medium (i.e. of pH<7) and preferably at a pH ranging from 2 to 5.

The core made of copper or copper alloy may be submerged in an aqueous electrolysis bath containing a copper precursor, a zinc precursor and a tin precursor. In the electrolysis bath, the copper precursor may be chosen from copper cyanide and copper sulfate, the zinc precursor may be zinc sulfate, and the tin precursor may be tin sulfate. The copper, zinc and tin are then codeposited on said core, i.e. the tin, zinc and copper are alloyed during their deposition on the core of copper or copper alloy. In this case, the electrolytic bath contains the copper, zinc and tin precursors in proportions chosen to be identical to those of the alloy forming the white-bronze layer, respectively. By way of example, the bath may contain from about 10 to 15 g/l copper precursor(s), from about 10 to 20 g/l tin precursor(s), and from about 0 to 5 g/l zinc precursor(s).

In one preferred embodiment, the electrolytic parameters used during the electrodeposition are set by a current density and a conductivity of the electrolysis bath. For a desired thickness on a prototype copper core, the current density is preferably set to about 0.5 to 60 $A/dm^2$, and more preferably to about 1 to 5 $A/dm^2$. The temperature of the electrolysis bath may range from 25° C. to 65° C., and preferably from about 55 to 65° C.

The electrodeposition method allows the formation of a continuous jacket (without irregularities or without roughness) around the core made of copper or copper alloy to be controlled and promoted.

Thus, the white-bronze layer is preferably not formed around the core made of copper or copper alloy by a thermal reflow treatment.

Specifically, this type of process consists in depositing on a metal part a copper layer then a tin layer, and in heating the assembly, especially to a temperature of at least 150° C., in order to allow the copper to diffuse into the tin layer and thus form an intermetallic copper/tin alloy layer between the copper layer and the tin layer. In this process the copper/tin alloy layer is formed in situ and it is difficult to control its thickness and to obtain a substantially regular surface. In addition, the intermetallic layer obtained by this process is brittle or fragile, thereby decreasing the ability of the electrically conductive element to withstand bending. Lastly, this process does not allow a white-bronze layer that furthermore contains zinc to be formed.

The second subject of the present invention is an electrical cable comprising at least one elongate electrically conductive element such as defined in the present invention, and at least one polymer layer encircling said electrically conductive element.

In one preferred embodiment, said polymer layer makes direct contact with the white-bronze layer of the elongate electrically conductive element.

The polymer layer may be an electrically insulating layer.

According to one particularly preferred embodiment of the invention, the polymer layer comprises polytetrafluoroethylene (PTFE) or a copolymer of tetrafluoroethylene and hexafluoropropylene (FEP).

The polymer layer is, preferably, a layer extruded using techniques well known to those skilled in the art.

BRIEF DESCRIPTION OF THE DRAWINGS

The electrical cable of the invention is preferably a low-voltage (especially lower than 6 kV) or medium-voltage (especially from 6 to 45-60 kV) power cable.

FIG. 1 schematically shows a structure, in cross section, of an electrical cable according to the invention.

FIG. 1 shows an electrical cable comprising an elongate electrically conductive element comprising a core (1-1) made of copper or copper alloy and a white-bronze layer (1-2) encircling said core (1-1) made of copper or copper alloy; and a polymer layer (2) encircling said elongate electrically conductive element. The thickness of the white-bronze layer is indicated by the arrow and the reference.

DETAILED DESCRIPTION

Examples

Example 1

Manufacture of an Elongate Electrically Conductive Element According to the Invention A 5 μm-thick white-bronze layer as applied by electrodeposition to a copper wire of 2.57 mm diameter.

The alkaline electrolysis bath prepared contained about 14 g/l copper, about 55 g/l free cyanide, about 19 g/l free potassium hydroxide, about 20 tin and about 4 zinc. The pH of the bath was about 13.3. The current density was about 1.5 A/dm$^2$ and the temperature of the electrolysis bath was about 62° C.

The composition of the white-bronze layer encircling the copper core was 51% by weight copper, 33% by weight tin and 16% by weight zinc. This composition was analyzed using an EDX energy dispersive spectrometer (20 kV, ×1000, ±1 wt %) sold under the trade name 227A 1SUS by Noran instruments and using a scanning electron microscope SEM sold under the trade name JSM5310 by JEOL.

Example 2

Corrosion Resistance and Temperature Withstand of the Elongate Electrically Conductive Element According to the Invention The elongate electrically conductive element such as prepared above in Example 1 underwent elevated temperature aging for 2 hours at 200° C., or for 10 minutes at 300° C., or for 10 minutes at 370° C.

Table 1 below indicates the chemical composition of the white-bronze layer before ageing and its variation as a function of the ageing carried out.

TABLE 1

| | chemical composition of the white-bronze layer of the electrically conductive element of the invention | | |
|---|---|---|---|
| | Cu (% by weight) | Sn (% by weight) | Zn (% by weight) |
| Before ageing | 51 | 33 | 16 |
| 200° C./2 h | 51 | 34 | 15 |
| 300° C./10 min | 53 | 30 | 17 |
| 370° C./10 min | 48 | 36 | 16 |

Thus, from the results in Table 1, it may be seen that no change in the chemical composition of the white-bronze layer of the invention was observed, it thus has a good temperature withstand.

Moreover, no change in the color of said layer was observed during these various elevated temperature ageing tests, whereas when a bare copper wire was used (i.e. a wire comprising only a copper core and not comprising a white-bronze layer) a notable change in color was observed. Specifically, the bare copper wire became brown when aged at 300° C. for 10 min and black when aged at 370° C. for 10 min, these colors being characteristic of the oxidation of the copper in air, and therefore of the formation of a surface oxide layer.

Lastly, a neutral salt spray corrosion-resistance test was carried out according to standard ISO 9227-ASTM B117 on the electrically conductive element of the invention before ageing using an apparatus sold under the trade name 610e/400 by the company Erichsen. No corrosion was observed after 96 hours at 35° C. in the presence of 5% by weight NaCl, thus demonstrating a good corrosion resistance.

Example 3

Mechanical and Electrical Properties of the Elongate Electrically Conductive Element According to the Invention Table 2 below collates the electrical and mechanical properties of an elongate electrically conductive element such as prepared above in Example 1 before ageing and after ageing at a temperature of 370° C. for 10 minutes, and, by way of comparison, the electrical and mechanical properties of a bare copper wire before ageing and after elevated temperature ageing at 370° C. for 10 minutes.

The resistance per unit length (RL) was measured using a resistivity testbed equipped with a micro-ohmmeter sold under the trade name MGR10 by the company SEFELEC.

The electrical resistivity (in μΩ~cm) of the coated elongate electrically conductive element was calculated from the resistance per unit length RL, the diameter of the elongate electrically conductive element and the length of said element.

The electrical conductivity was calculated from the electrical resistivity of the coated elongate electrically conductive element and the electrical resistivity of copper.

The mechanical strength (Rm) or tensile strength (A) or elongation at break were measured using an apparatus sold under the trade name DY35 by the company Adarnel Lhornergy.

TABLE 2

| | Bare Cu wire | Cu core covered with white bronze | Bare Cu wire | Cu core covered with white bronze |
|---|---|---|---|---|
| | Before ageing | | After ageing 370° C./10 min | |
| Diameter (mm) | 0.992 | 0.992 | 0.992 | 0.992 |
| Length (m) | 1.000 | 1.000 | 1.000 | 1.000 |
| RL (mΩ/m) | 22.255 | 22.669 | 21.700 | 22.131 |
| Resistivity (μΩ · cm) | 1.720 | 1.752 | 1.677 | 1.717 |
| Electrical conductivity (% IACS) | 100.2 | 98.4 | 102.8 | 100.4 |
| Rm (MPa) | 430 | 430 | 230 | 230 |
| A (%) | 1 | 1 | 20 | 20 |
| Appearance of the wire | red | gray | black | gray |

Thus, table 2 shows that the presence of the white-bronze layer in the elongate electrically conductive element of the invention allows corrosion resistance (appearance of the wire) to be improved while preserving good electrical properties (electrical conductivity, resistance per unit length and resistivity) and mechanical properties (tensile strength, elongation at break) relative to an electrically conductive element consisting only of a copper core (i.e. without the white-bronze layer).

Example 4

Other Properties of the Elongate Electrically Conductive Element According to the Invention Ability to Withstand Drawing The drawing process is a cold shaping process that consists in stretching a metal wire while gradually decreasing its diameter through tools called dies. The diameter of the elongate electrically conductive element such as obtained above was decreased from 2.57 mm to 1.024 mm by virtue of a die sold by the company Esteves. This allowed the compression that is generally applied when forming an electrical cable to be simulated.

It would appear from the results of the drawing test that the elongate electrically conductive element according to the invention draws well. In other words, said white-bronze layer remains in place everywhere on the surface of the copper core with no discontinuities or cracks being observed to form, meaning that said white-bronze layer adheres well to the copper core. In addition, the white-bronze layer possesses the properties required to withstand the compressive force applied when forming cables.

Example 5

Solderability

The elongate electrically conductive element before ageing and such as prepared above in Example 1 was subjected to a solderability test according to standard TEC-60068-2-20. The test was carried out at 3 angles of rotation (0°, 120° and 240°) and at a temperature of 235° C.

The time taken for wetting to occur was lower than 1 second, indicating that the elongate electrically conductive element of the invention has a good solderability.

The invention claimed is:

1. Elongate electrically conductive element comprising:

a core made of copper or copper alloy; and at least one white-bronze layer encircling said core made of copper or copper alloy, wherein said white-bronze layer is the outermost layer of the elongate electrically conductive element, and contains from 20% to 57% tin by weight.

2. Elongate electrically conductive element according to claim 1, wherein the white-bronze layer is covered by no other metal layer.

3. Elongate electrically conductive element according to claim 1, wherein the white-bronze layer has a substantially regular surface.

4. Elongate electrically conductive element according to claim 1, wherein the white-bronze layer furthermore contains zinc.

5. Elongate electrically conductive element according to claim 1, wherein the white-bronze layer contains from 40 to 55% by weight copper.

6. Elongate electrically conductive element according to claim 1, wherein the white-bronze layer contains from 30 to 57% by weight tin.

7. Elongate electrically conductive element according to claim 4, characterized in that the white-bronze layer contains from 3% to 20% by weight zinc.

8. Elongate electrically conductive element according to claim 1, wherein the white-bronze layer has a thickness ranging from 0.1 to 100 μm.

9. Elongate electrically conductive element according to claim 1, characterized in that the white-bronze layer makes direct contact with the core made of copper or copper alloy.

10. An electrical cable comprising:

at least one elongate electrically conductive element as defined in claim 1; and at least one polymer layer encircling said electrically conductive element.

11. Electrical cable according to claim 10, wherein said polymer layer makes direct contact with the white-bronze layer of the elongate electrically conductive element.

12. Electrical cable according to claim 10, wherein the polymer layer comprises either one of polytetrafluoroethylene (PTFE) or a copolymer of tetrafluoroethylene and hexafluoropropylene (FEP).

13. Electrical cable according to claim 10, wherein said electrical cable is a low-voltage or medium-voltage power cable.

* * * * *